US005122498A

United States Patent [19]

Nishida et al.

[11] Patent Number: 5,122,498

[45] Date of Patent: Jun. 16, 1992

[54] MICROCAPSULES OF PRESSURE-SENSITIVE COPYING PAPER

[75] Inventors: Taisuke Nishida; Jun Miki; Tadao Kimura; Hiroaki Taniguchi, all of Tokyo, Japan

[73] Assignee: NKK Corporation, Tokyo, Japan

[21] Appl. No.: 565,182

[22] Filed: Aug. 8, 1990

Related U.S. Application Data

[62] Division of Ser. No. 244,792, Sep. 14, 1988, abandoned.

[30] Foreign Application Priority Data

Sep. 17, 1987 [JP] Japan ..... 62-230919

[51] Int. Cl.[5] ..... B41M 5/165

[52] U.S. Cl. ..... 503/213; 503/215

[58] Field of Search ..... 503/213, 215; 427/150–152

[56] References Cited

U.S. PATENT DOCUMENTS 3,917,477 11/1975 Hashimoto et al. ..... 585/25
4,387,256 6/1983 Henderson et al. ..... 585/25
4,783,438 11/1988 Okada et al. ..... 503/206

FOREIGN PATENT DOCUMENTS 47-8665 5/1972 Japan .
47-22212 10/1972 Japan .
47-26213 10/1972 Japan .
47-26214 10/1972 Japan .
47-31718 11/1972 Japan .
47-41908 12/1972 Japan .
47-41909 12/1972 Japan .
47-41910 12/1972 Japan .
47-41911 12/1972 Japan .
47-41912 12/1972 Japan .
47-41913 12/1972 Japan .
47-41914 12/1972 Japan .
48-86614 11/1973 Japan .
48-92112 11/1973 Japan .
49-2125 1/1974 Japan .
49-2126 1/1974 Japan .
49-5928 2/1974 Japan .
49-8289 2/1974 Japan .
49-21608 6/1974 Japan .

*Primary Examiner*—Bruce H. Hess
*Attorney, Agent, or Firm*—Frishauf, Holtz, Goodman & Woodward

[57] ABSTRACT

A dye solvent useful as a material for microcapsules necessary for the manufacture of pressure-sensitive manifold paper. This solvent essentially consists of a hydroaromatic compound for pressure-sensitive manifold paper. The compound is a polycyclic aromatic compound with three or more aromatic rings, some of which rings have been hydrogenated and exhibits solvency, particularly, for a black pigment and a blue pigment of leuco dye.

6 Claims, No Drawings

MICROCAPSULES OF PRESSURE-SENSITIVE COPYING PAPER

This application is a division of application Ser. No. 07/244,792, filed Sep. 14, 1988, now abandoned.

BACKGROUND OF THE INVENTION

1. Field of the Invention

This invention relates to a solvent for use in making pressure-sensitive manifold paper and more specifically to a solvent for dyes as the materials for microcapsules of pressure-sensitive manifold paper.

2. Description of the Related Art

The initial solvent for the solvent for microcapsules was polychloro biphenyl, the production of which was terminated due to the problem of environmental pollution. Among the solvents currently available in the market are alkyl naphthalene (Japanese Patent Disclosure Nos. 47-41908 through -41914 and Japanese Patent Publication No. 49-5928), diallyl ethane (Japanese Patent Disclosure No. 47-31718, Japanese Patent Disclosure No. 47-26213, Japanese Patent Publication No. 49-2126), alkyl biphenyl (Japanese patent Publication No. 49-21608, Japanese Patent Disclosure No. 47-8665 and Japanese Patent Disclosure No. 47-22212), hydrogenated terphenyl (Japanese Patent Publication 49-2125, Japanese Patent Disclosure No. 48-92112, corresponding to U.S. patent application No. 225,658), and triallyl diethane (Japanese Patent Publication No. 49-8289, Japanese Patent Disclosure No. 47-26214, Japanese Patent Disclosure No. 48-86614). The solvents, the development of which are now under way, include tetralin derivatives.

In practical use, these solvents are used after diluted with a petroleum fraction such as kerosine, naphtha and paraffin or a synthetic oil such as chlorinated paraffin and chlorinated biphenyl or animal oil, vegetable oil, or mineral oil. The dilution is done for the purpose of cost reduction.

The required conditions of the solvent are as follows.

1. Dissolves leuco dyes as color formers at high concentrations.
2. Has a high boiling point and does not evaporate in the thermodrying process or in an environment of high temperature.
3. Does not dissolve into water in the capsulation process.
4. Does not disensitize the color formers or inhibit their action on the lower sheet of the pressure-sensitive manifold paper. The word "disensitize" here means deteriorating the developing capacity of the developer or making the developer lose its capacity.
5. Has a high adsorptive affinity with the developer, that is, color-reactive substances and thereby contributes to favorable color development.
6. Has excellent resistance to acids and alkalis and is stable chemically.
7. Has a viscosity low enough to allow the dye to freely seep from the capsule wall and has a very little rise in viscosity even at low temperatures.
8. Is colorless or has a very light color.
9. Has no disagreeable smell.
10. Has a low toxicity.

Some of the solvents currently sold in the market have a boiling point from 280° to higher than 300° C., a flow point of lower than about −30° C. and a kinematic viscosity of less than 10 cp at 25° C. These solvents meet the requirements of 2 and 7 above, do not pose a problem of environmental pollution, help improve the copying speed and enable their use in the frigid regions.

Those commercial products are the solvents containing non-condensed or condensed polycyclic compounds having the alkyl groups and hydrogen groups and which therefore are manufactured by employing a complicated reaction path.

The solvency of these commercial solvents to the black leuco dye is 3.5 wt % and that of the commercial solvents to the blue leuco dye is about 10 wt %. The solvent users call for solvents with a high solvency for various dyes, that is, a solvency of 7 to 10 wt % for a black dye for example. The reason is as follows. The solvent is blended in the subsequent process with a diluting agent. For dissolution of a leuco dye by a solvent before this blending, the users want to use a solvent having a highest possible dissolving power for leuco dyes.

SUMMARY OF THE INVENTION

The object of this invention is to provide a solvent for pressure-sensitive manifold paper with an extremely high dissolving power for the black and blue.

To achieve the above object, the solvent for pressure-sensitive manifold paper of this invention essentially consists of hydroaromatic compounds. Said hydrocompounds contain polycyclic aromatic compounds each having three or more aromatic rings, some of which have been hydrogenated. In addition, said hydroaromatic compounds contain 13 to 84.4 wt %, preferably, 13 to 48 wt % of polycyclic hydroaromatic compounds with three or more aromatic rings, some of which rings have been hydrogenated.

Since of the hydroaromatic compounds of this invention have some of their aromatic rings hydrogenated, the aromatic ring portion of the compounds has a strong affinity with the aromatic ring portion of the dye. In addition, since the hydro-ring portion which has been partially hydrogenated shows fluidity, the dispersion properties of the leuco dye can thereby be improved. Therefore, such hydroaromatic compounds have a higher dissolving power than the conventional solvents, which makes it possible to use greater amounts of diluting agents and reduce production cost.

DETAILED DESCRIPTION OF THE PREFERRED EMBODIMENTS

The polycyclic hydroaromatic compounds with three or more aromatic rings, some of which rings have been hydrogenated, according to this invention comprises dihydrophenanthrene, tetrahydrophenanthrene, octahydrophenanthrene, decahydrophenanthrene, tetrahydroanthracene and octahydroanthracene. In this invention, the proportion of the hydrogenated hydroaromatic compounds in the whole of a hydroaromatic compound is preferably 13 to 84.4 wt % and most preferably 13 to 48 wt % in order to meet two requirements of the fluidity and the affinity with the dye.

Various kinds of starting material can be used to manufacture the solvent according to the present invention, the examples of which are:

1 Creosote oil which is a compound of a relatively high boiling point

2 Products obtained from thermal cracked petroleum naphtha

3 Products separated out by hydrocracking of tar pitch, petroleum pitch or the like 4 Products obtained from heavy oil 5 Products obtained by synthesis of monocyclic or bicyclic compounds such as benzene and naphthalene or of long chain fatty oils The solvent according to this invention is made from these starting materials by combining the conventional processes such as the hydrogenation process, the fractionating distillation process and the viscosity control process as required and by setting suitable processing conditions.

To produce the solvent of this invention from creosote oil as a starting material, the hydrogenation process is applied to creosote oil. In the hydrogenation process, in the presence of a catalyst made of a noble metal such as palladium or platinum supported by active carbon, silica, alumina or the like, creosote oil reacts with hydrogen at 200° C. to 400° C. for one to ten hours in the nitrogen atmosphere of 50 to 250 kg/cm$^2$. Or in the presence of a catalyst made of a metal such as nickel, cobalt or molybdenum supported by silica, alumina or the like, creosote oil reacts with hydrogen at 200° C. to 400° C. for one to ten hours in the hydrogen atmosphere of 100 to 250 kg/cm$^2$. In this hydrogenation process, some of the aromatic rings of an aromatic compound of creosote oil can be hydrogenated. When a creosote oil containing a large amount of tricyclic aromatic compounds such as anthracene and phenanthrene is subjected to the hydrogenation process, these aromatic compounds are changed into hydroaromatic compounds which have no crystallinity and exhibit an extreme fluidity. The hydrogenated creosote oil is subjected, if necesssary, to refining using the active carbon or activated clay or to adjusting boiling point by distillation.

The solvent of this invention is a mixture obtained by subjecting a starting material to the hydrogenation process as described above. Therefore, the earlier-mentioned required conditions of the solvent can be satisfied by selecting the hydrogenating conditions and distillates according to the physical properties required for the solvent.

The advantage of the hydrogenation process is that about 1.0 wt % of the nitrogen compounds and about 0.5 wt % of sulfur compounds contained in the material oil can be reduced to 0.7 to 0.2 wt % and 0.2 to 0.05 wt %, respectively, under the conditions of the preferred embodiments to be described below. Hence, the subsequent refining process can be simplified remarkably.

The fact that the solvent of this invention is basically a mixture of compounds makes it possible to arbitrarily select a starting material. Generally, coal-based creosote oils are used as starting materials. The other applicable starting materials include petroleum-cracked oils, tar pitch, hydrocracked oils of petroleum pitch, petroleum, heavy gravity crude oil, and mixed oils of polycyclic compounds obtained by synthesis of benzene, naphthalene and the like.

Using a solvent thus produced, pigments (leuco dyes) for transfer are dissolved and the dissolved pigments are capsulated with gelatin in the subsequent process. The microcapsules are then applied on the upper sheet of the pressure-sensitive manifold paper.

This invention will now be described referring to the following embodiments.

EXAMPLE 1

Phenanthrene, a representative component of creosote oil, was treated by the hydrogenation process. This hydrogenation treatment was carried out with 50g of phenanthrene of specified purity as a reagent and 5g of $Pt/Al_2O_3$ catalyst charged at the temperature of 250° C. into an autoclave being 300 cc of inner volume and provided with an agitator under a hydrogen pressure of 150 to 190 kg/cm$^2$ and for the duration of 8.0 hours. The hydrogenated substance obtained was a mixture consisting of 35.9 wt % of dihydrophenanthrene, 4.0 wt % of tetrahydrophenanthrene, 44.5 wt % of octahydrophenanthrene and 10.5 wt % of the balance. Therefore, the polycyclic hydroaromatic compound, some of the aromatic rings of which have been hydrogenated, is contained in the whole mixture of the hydroaromatic compound at least 84.4 wt % of the total.

EXAMPLE 2

Into an autoclave similar to that used in Example 1, 40 g of anthracene oil isolated from coal tar at 280° C. to 350° C. and 4 g of $Ni/Al_2O_3$ catalyst were charged and the mixture was hydrogenated at 380° C. , under a hydrogen pressure of 160 kg/cm$^2$ and for 8.0 hours. The hydrogenated substance thus obtained was decolored by a silica gel absorbent.

The hydrogenated substance was a mixture consisting of 45.6 wt % of phenanthrene, 1.9 wt % of dihydrophenanthrene, 5.5 wt % of tetrahydrophenanthrene, 7.3 wt % of octahydroanthracene, 3.0 wt % of methyl phenanthrene, 2.0 wt % of methyl fluorene and 34.7 wt % of the balance. Therefore, the polycyclic hydroaromatic compound, some of the aromatic rings of which have been hydrogenated, is contained in the whole mixture of the hydroaromatic compound at least 14.7 wt % of the total.

EXAMPLE 3

In this example, 40 g of the hydogenated substance obtained in Example 2 and 4 g of $pd/Al_2O_3$ catalyst were charged into an autoclave as used in Example 1 and the mixture was hydrogenated at 300° C., under a hydrogen pressure of 100 kg/cm$^2$ and for 12.0 hours. The hydrogenated substance thus obtained was decolored by a silica gel absorbent. Then, fractions of 280° to 330° C. were drawn off by distillation. The thus obtained mixture consists of 20.7 wt % of dihydrophenanthrene, 6.3 wt % of tetrahydrophenanthrene, 10.0 wt % of octahydrophenanthrene, 2.8 wt % of decahydrophenanthrene, 4.3 wt % of octahydroanthracene, 3.4 wt % of tetrahydroanthracene and 52.5 wt % of the balance. Therefore, the polycyclic hydroaromatic compound, some of the aromatic rings of which have been hydrogenated, contains 20.7 wt % of dihydrophenanthrene as the main component and is contained in the whole mixture of the hydroaromatic compound at least 47.5 wt % of the total.

EXAMPLE 4

In this example, 40 g of the hydrogenated substance obtained in Example 3 and 4 g of $Pt/Al_2O_3$ catalyst were charged into an autoclave as used in Example 1 and the mixture was hydrogenated at 350° C., at a hydrogen pressure of 100 kg/cm$^2$ and for 8.0 hours. The hydrogenated substance thus obtained was subjected to fractional distillation to take out fractions of 280° C. to 330° C.

The thus obtained mixture of fractions consists of 3.8 wt % of dihydrophenanthrene, 4.8 wt % of tetrahydrophenanthrene, 38.9 wt % of octahydrophenanthrene, 1.8 wt % of decahydrophenanthrene, 4.6 wt % of anthracene, 6.4 wt % of octahydroanthracene and 39.7 wt % of the balance. Therefore, the polycyclic hydroaromatic compound contains 38.9 wt % of octahydrophenanthrene as the main component and is contained in the whole mixture of the hydroaromatic compound at least 84.4 wt % of the total.

EXAMPLE 5

The hydrogenated substance obtained in Example 3 was subjected to fractional distillation to take out fractions of 250° C. to 320° C. The thus obtained mixture of fractions consists of 12.5 wt % of fluorene, 8,3 wt % of dibenzofuran, 6,4 wt % of acenaphthene, 3,7 wt % of methyl acenaphthene, 3.8 wt % of methyl dibenzofuran, 6.1 wt % of octahydroanthracene, 6.8 wt % of tetrahyddrophenanthrene, 5.3 wt % of methyl tetrahydrophenathrene and 47.1 wt % of the balance. Therefore, the polycyclic hydroaromatic compound, some of the aromatic rings of which have been hydrogenated, is contained in the whole mixture of the hydroaromatic compound at least 18.0 wt % of the total.

Table 1 shows the measured values of the dissolving power of the solvents according to this invention, obtained in Examples 1 to 5 and the measured values of the commercial solvents (SAS-296 made by Nippon Petrochemicals Co., Ltd. and KMC-113 made by Kureha Chemical Industry Co., Ltd.) in the Comparatives 1 and 2. The dissolving power of the solvents was measured with regard to leuco dyes for microcapsules.

TABLE 1

| | Dissolves Amounts of Leuco Dyes* | |
|---|---|---|
| | Black dye | Blue dye |
| Example 1 | 6.4 | 19.1 |
| Example 2 | 12.2 | 22.5 |
| Example 3 | 12.1 | 23.2 |
| Example 4 | 3.2 | 9.6 |
| Example 5 | 10.0 | 22.3 |
| Comparative 1 | 3.5 | 10.1 |
| Comparative 2 | 3.4 | 9.8 |

*The dissolved amounts are expressed by the number of grams of dyes dissolved in 100 g of a capsule oil.

As can be understood from the above table, compared with the dissolving power of the commercial solvents of 3.4 g and 3.5 g of the black dye, the solvent in Example 1 has a black dye dissolving power twice as high and the solvents of Examples 2, 3 and 5 exhibit a dissolving power of 2.9 to 3.5 times as high except for the solvent in Example 4 which showed a dissolving power almost equal to that of the commercial solvents. The blue leuco dye dissolving power of the solvent of this invention is about twice as high as that of the commercial solvents.

Table 2 shows the measurement results of the freezing point, viscosity, coloring properties, odor and transfer properties of the solvents of Examples 1 to 5 in comparison with those of the Comparatives.

TABLE 2

| | Freezing point | Viscosity* | Coloring properties | Odor | Transfer** properties |
|---|---|---|---|---|---|
| Example 1 | −35° C. | — | Colorless | Odorless | Good |
| Example 2 | −41° C. | 26.0 cp | Colorless | Odorless | Good |
| Example 3 | −44° C. | 25.6 cp | Colorless | Odorless | Good |
| Example 4 | −48° C. | — | Colorless | Odorless | Good |
| Example 5 | −55° C. or below | 12.4 cp | Colorless | Odorless | Good |
| Comparative 1 | −34° C. | 10 cp | Colorless | Odorless | Good |
| Comparative 2 | −40° C. | 14.4 cp | Colorless | Odorless | Good |
| Comparative 3 | ***— | — | Dark brown | Strong Odor | — |

*The viscosity of Examples 2, 3 and 5 and of Comparative 2 was at 25.5° C. and the viscosity of Embodiment 5 was at 26° C.
**The transfer properties Were investigated by observing the color development while transfer was done by a mechanical impact on the lower sheet coated with a phenol resin.
***In Comparative 3, creosote oil was used.

As is clear from Table 2, in the viscosity which serves as the indicator of fluidity the solvent of Example 5 of this invention showed a level of viscosity equivalent to that of the commercial solvents and the solvents of Example 2 and 3 showed a little higher values. These values pose no problem in practical use of the solvents. All the solvents embodying the present invention showed the freezing points lower than those of the commercial solvents.

What is claimed is:

1. In a pressure-sensitive manifold paper, of the type having an upper sheet carrying microcapsules of leuco dyes dissolved in a solvent, the improvement comprising said solvent comprising a hydroaromatic compound selected from the group consisting of a hydrogenated phenanthrene, a hydrogenated anthracene, and a mixture thereof.

2. The manifold paper according to claim 1, wherein said hydroaromatic compound is selected from the group consisting of dihydrophenanthrene, tetrahydrophenanthrene, octahydrophenanthrene, decahydrophenanthrene, tetrahydroanthracene and octahydroanthracene and a mixture thereof.

3. Pressure-sensitive manifold paper according to claim 2, wherein said solvent contains 13–18.4 weight % of said hydroaromatic compounds.

4. Pressure-sensitive manifold paper according to claim 1, wherein said solvent contains 13–84.4 weight % of said hydroaromatic compounds.

5. Pressure-sensitive manifold paper according to claim 1, wherein said solvent contains 13–48 weight % of said hydroaromatic compounds.

6. Pressure-sensitive manifold paper according to claim 1, wherein said hydroaromatic compounds are formed by hydrogenating a creosote oil.

* * * * *